US009215906B2

(12) United States Patent
Polegato Moretti

(10) Patent No.: US 9,215,906 B2
(45) Date of Patent: Dec. 22, 2015

(54) WATERPROOF AND VAPOR-PERMEABLE SHOE

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 1021 days.

(21) Appl. No.: 13/141,530

(22) PCT Filed: Dec. 4, 2009

(86) PCT No.: PCT/EP2009/066442
§ 371 (c)(1),
(2), (4) Date: Jun. 22, 2011

(87) PCT Pub. No.: WO2010/072547
PCT Pub. Date: Jul. 1, 2010

(65) Prior Publication Data

US 2011/0252667 A1 Oct. 20, 2011

(30) Foreign Application Priority Data

Dec. 22, 2008 (IT) ..... PD2008A0377

(51) Int. Cl.
*A43B 13/28* (2006.01)
*A43B 7/08* (2006.01)
*A43B 23/02* (2006.01)
(Continued)

(52) U.S. Cl.
CPC . *A43B 7/08* (2013.01); *A43B 7/087* (2013.01); *A43B 7/125* (2013.01); *A43B 9/00* (2013.01); *A43B 13/14* (2013.01); *A43B 23/022* (2013.01)

(58) Field of Classification Search
CPC ..... A43B 7/125; A43B 7/08; A43B 23/022; A43B 9/02; A43B 9/00
USPC ..... 36/12
See application file for complete search history.

(56) References Cited

U.S. PATENT DOCUMENTS 5,689,903 A * 11/1997 Aumann ..... 36/77 R
5,711,093 A * 1/1998 Aumann ..... 36/77 R
(Continued)

FOREIGN PATENT DOCUMENTS

CN 1731942 A 2/2006
CN 101232826 A 7/2008
(Continued)

OTHER PUBLICATIONS

International Preliminary Report on Patentability issued in PCT/EP2009/066442 on Jun. 29, 2011.
(Continued)

*Primary Examiner* — Ted Kavanaugh
(74) *Attorney, Agent, or Firm* — Oblon, McClelland, Maier & Neustadt, L.L.P.

(57) ABSTRACT

A waterproof and vapor-permeable shoe, including an upper that is lined at least partially by an upper membrane impermeable to water in a liquid state and permeable to water vapor. The upper membrane is connected hermetically to a sole which is impermeable to water in the liquid state. The hermetic connection is provided by a sealing element included in an assembly insole. The sealing element is permeable with respect to sealing material, or a glue, sealing adhesive, or polymeric material for providing the sole, and is impregnated with the sealing material, which grips the upper membrane and is connected to the sole or forms a single body therewith, sealing it to the upper membrane.

11 Claims, 5 Drawing Sheets

(51) Int. Cl.

| | |
|---|---|
| ***A43B 13/14*** | (2006.01) |
| ***A43B 7/12*** | (2006.01) |
| ***A43B 9/00*** | (2006.01) |

(56) References Cited

U.S. PATENT DOCUMENTS

| | | | | |
|---|---|---|---|---|
| 6,408,541 | B1 * | 6/2002 | Moretti | 36/12 |
| 7,219,446 | B1 * | 5/2007 | Haimerl | 36/12 |
| 7,823,297 | B2 | 11/2010 | Polegato Moretti | |
| 2006/0248751 | A1 * | 11/2006 | Haimerl | 36/45 |
| 2008/0216358 | A1 * | 9/2008 | Polegato Moretti | 36/3 A |
| 2009/0188134 | A1 | 7/2009 | Polegato Moretti | |
| 2009/0300942 | A1 | 12/2009 | Peikert | |
| 2010/0050480 | A1 | 3/2010 | Polegato | |
| 2010/0064453 | A1 | 3/2010 | Haimerl | |
| 2010/0132228 | A1 | 6/2010 | Polegato Moretti | |

FOREIGN PATENT DOCUMENTS

| | | | |
|---|---|---|---|
| DE | 20 2007 000 668 | | 3/2007 |
| DE | 10 2006 009 974 | A1 | 9/2007 |
| JP | 2006-512132 | A | 4/2006 |
| JP | 2008-508004 | A | 3/2008 |
| JP | 2009-502272 | A | 1/2009 |
| JP | 2009-538646 | A | 11/2009 |
| TW | 200812516 | A | 3/2008 |
| WO | WO 2006/010578 | A1 | 2/2006 |
| WO | WO 2007/012415 | A1 | 2/2007 |
| WO | WO 2007/137604 | A1 | 12/2007 |
| WO | WO 2008/003375 | A1 | 1/2008 |
| WO | 2008 116772 | | 10/2008 |
| WO | 2008 119683 | | 10/2008 |

OTHER PUBLICATIONS

Combined Office Action and Search Report issued Sep. 24, 2014 in Taiwanese Patent Application No. 098144265 (with English language translation).

U.S. Appl. No. 13/611,536, filed Sep. 12, 2012, Polegato Moretti.

U.S. Appl. No. 13/393,090, filed Feb. 28, 2012, Polegato Moretti.

International Search Report Issued Apr. 6, 2010 in PCT/EP09/066442 filed Dec. 4, 2009.

Office Action issued Nov. 26, 2013 in Japanese Patent Application No. 2011-541304 (with English language translation).

U.S. Appl. No. 13/263,822, filed Oct. 10, 2011, Polegato Moretti.

* cited by examiner

WATERPROOF AND VAPOR-PERMEABLE SHOE

TECHNICAL FIELD

The present invention relates to a waterproof and vapor-permeable shoe.

BACKGROUND ART

The fact is currently known that the comfort of a shoe is linked not only to correct anatomically fitting properties but also to correct outward permeation of the water vapor formed inside the shoe due to perspiration.

Traditionally, vapor-permeable shoes are those which use natural materials such as leather or equivalent products, which however, in the presence of rain or bad weather, because of their vapor-permeable properties, do not ensure good waterproofness and indeed absorb water rather easily.

For this reason, shoes with an upper made of leather (or the like) associated to a lining with a vapor-permeable and waterproof membrane (made for example of a material such as expanded polytetrafluoroethylene, e-PTFE, polyurethane, PU, or the like), sewn or glued to an insole, have now been in use for several years.

Moreover, as is known, however, most of the perspiration of the foot is generated at the interface between the sole of the foot and the sole of the shoe, which is typically made of polymeric material.

It is evident that the perspiration that has formed on such interface is unable to evaporate, accordingly condensing on the footbed on which the foot rests; only a minor percentage of the perspiration evaporates through the upper.

Accordingly, shoes have now been devised for years which have vapor-permeable and waterproof soles (such as for example the one disclosed in Italian patent no. 1,282,196), which are associated with waterproof and vapor-permeable uppers such as the ones described above, in order to provide shoes that are completely waterproof and vapor-permeable.

A shoe of this type is disclosed for example in WO097/14326.

The shoe disclosed in WO097/14326 in practice has a sole provided with a tread with holes and a membrane which is waterproof and vapor-permeable, covers the holes and is joined perimetrically and hermetically to the tread, so as to not allow infiltrations of water.

This sole ensures correct vapor permeation in addition to an effective exchange of heat and water vapor between the environment inside the shoe and the outside environment, at the same time ensuring the necessary tightness with respect to external moisture and water, in a manner similar to what is performed by the upper with which the membrane is associated.

In this shoe configuration, the sole and the upper are two distinct parts, both of which are vapor-permeable and waterproof, which are associated and sealed one another so as to avoid the rise of water in the connecting points.

The soles used in these shoes are therefore structured so as to allow vapor permeation but not the passage of water from outside inwardly; the structure of the sole is therefore more complicated than a traditional sole, and this complexity arises from the accommodation of the membrane and from the correct perimetric sealing of the latter with respect to the sole.

Usually, the structure of the upper of shoes of the described type is very complicated with respect to a traditional upper and this complexity arises from the need to fold the lining with the membrane onto itself so as to allow its sealing with an additional membrane arranged below the insole or from the need to have a lining with a membrane that is larger than the upper, so as to provide a perimetric seal of the latter with the sole.

Resorting to these solutions leads to some drawbacks that the shoe thus provided has: creases in fact form easily in the lining with membrane, whether folded or not, at the toe and at the heel, to the full detriment of an easy sealing of the membranes of the upper and of the one arranged at the insole.

In general, regardless of whether the sole is vapor-permeable or not, in the manufacture of these shoes it is important to pay attention to the sealing of the connecting regions between the insole, the lining with membrane and the sole, in order to avoid even the slightest seepage of water from outside.

SUMMARY OF THE INVENTION

The aim of the present invention is to provide a waterproof and vapor-permeable shoe that has an effective sealing of the connecting regions between the insole, the membrane and the sole.

Within this aim, an object of the invention is to propose a shoe which is waterproof and permeable to water vapor and is structurally simple to obtain.

Another object of the present invention is to provide a shoe that is completely waterproof and permeable to water vapor and is tough and durable.

Another object of the present invention is to provide a shoe that is waterproof and permeable to water vapor and can be manufactured with known systems and technologies.

This aim and these and other objects that will become better apparent hereinafter are achieved by a waterproof and vapor-permeable shoe, comprising an upper that is lined at least partially by an upper membrane which is impermeable to water in the liquid state and permeable to water vapor, said upper membrane being connected hermetically to a sole which is impermeable to water in the liquid state, characterized in that said hermetic connection is provided by means of a sealing element comprised in an assembly insole, said sealing element being permeable with respect to sealing material, such as glue, sealing adhesive or polymeric material for providing the sole, said sealing element impregnated with said sealing material gripping said upper membrane and being connected to said sole or forming a single body therewith, sealing said sole to said upper membrane.

BRIEF DESCRIPTION OF THE DRAWINGS

Further characteristics and advantages of the invention will become better apparent from the description of some preferred but not exclusive embodiments of the shoe according to the invention, illustrated by way of non-limiting example in the accompanying drawings, wherein.

Figure 1:
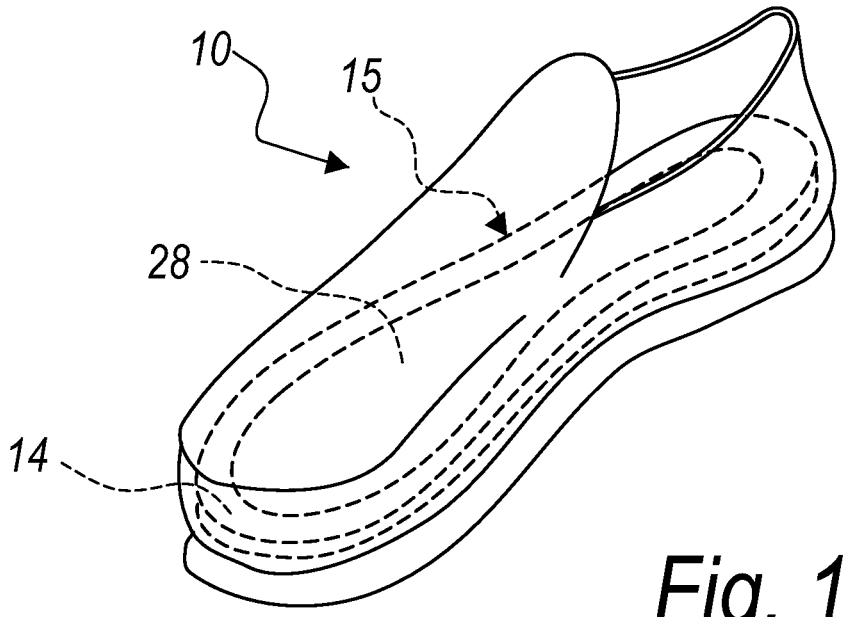
FIG. 1 is a perspective view of a shoe according to the invention.

It is noted that anything found to be already known during the patenting process is understood not to be claimed and to be the subject of a disclaimer.

WAYS OF CARRYING OUT THE INVENTION

With reference to the figures, the reference numeral 10 generally designates a waterproof and vapor-permeable shoe, which comprises an upper 11 that is lined at least partially by an upper membrane 12, which is impermeable to water in the liquid state and permeable to water vapor.

Advantageously, the upper is reinforced with a toe cap and a rear counter, which are not shown in the accompanying figures and both of which are vapor-permeable or perforated and joined to the upper by means of spots of glue in order to not prevent their vapor permeability.

The upper membrane 12 is connected hermetically to a sole 13 that is impermeable to water in the liquid state.

A particularity of the shoe 10 according to the invention consists in that said hermetic connection between the upper membrane 12 and the sole 13 is provided by means of a sealing element 14, which is comprised in an assembly insole 15.

Said sealing element 14 is permeable to sealing material, which for example can be glue or the polymeric material of which the sole is made, and is impregnated with said sealing material, which grips the upper membrane 12 and is connected to the sole 13, or forms a single body therewith, sealing the sole 13 to the upper membrane 12.

Preferably, the shoe 10 also comprises a vapor-permeable waterproof insert 16, which comprises a membrane 17 of the insert that is impermeable to water in the liquid state and permeable to water vapor, the insert being arranged at at least one vapor-permeable portion 18 of the sole 13, defined by an opening or a plurality of holes, which it covers.

The vapor-permeable waterproof insert 16, the sole 13 and the upper membrane 12 are connected hermetically at least through the sealing element 14, in order to make said shoe impermeable to water in the liquid state.

More generally, in alternative solutions, at least two among the vapor-permeable waterproof insert 16, the sole 13 and the upper membrane 12 are connected hermetically at least through the sealing element 14.

The sealing element 14 is advantageously provided at the peripheral region of the vapor-permeable portion 18 and of the membrane 17 of the insert that covers it.

Moreover, the sealing element 14 is conveniently made of a material selected among three-dimensional fabric, mesh made of synthetic material, mesh made of metallic material and aramid fiber fabric.

The shoe 10 advantageously comprises an inner lining 19.

Conveniently, a fine nylon mesh 20 is associated with the upper membrane 12 and is suitable to improve its handling.

In embodiments which are not described further there is more than one fine nylon mesh associated with the upper membrane.

Figure 8:
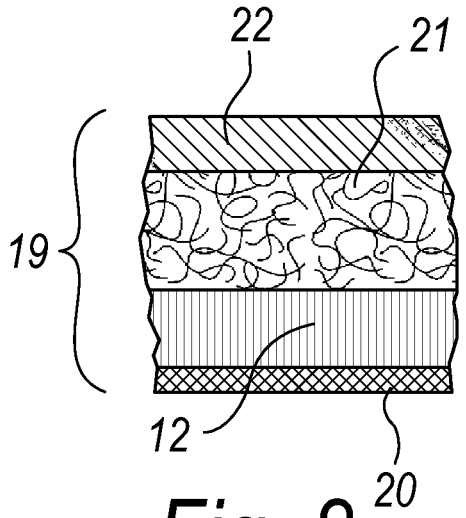
FIG. 8 is an enlarged-scale view of a detail of the cross-section of the upper part of the shoe according to the invention.

With particular reference to FIG. 8, the inner lining 19 preferably comprises

- a vapor-permeable padding 21 made of open-cell foamed polymer,
- a vapor-permeable layer 22 made of fabric or leather located inside the shoe 10.

The upper membrane 12 and the membrane 17 of the insert are preferably made of a material selected among expanded polytetrafluoroethylene, polyurethane and the like.

Figure 9:
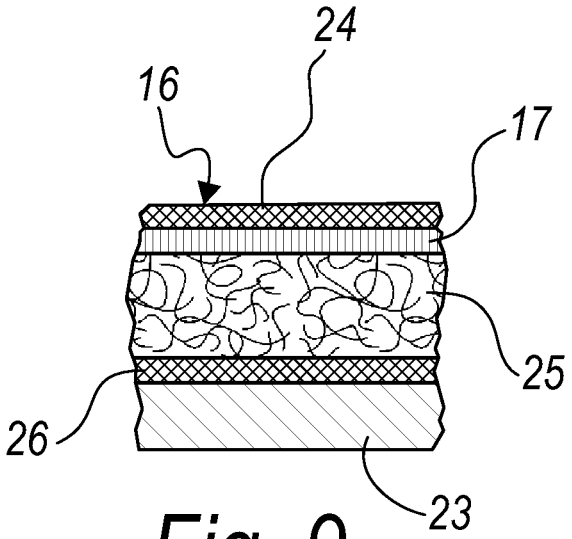
FIG. 9 is an enlarged-scale view of a detail of the cross-section of the sole of the shoe according to the invention.

With particular reference to FIG. 9, the vapor-permeable waterproof insert 16 comprises at least one among

- a vapor-permeable supporting layer 23, which is arranged below the membrane 17 of the insert and is provided if the extension or number of holes of the vapor-permeable portion 18 requires a reinforcement thereof in order to avoid the sinking of the foot of the user during use,
- a fine mesh 24 made of vapor-permeable synthetic material, for example nylon, which is associated in an upward region with respect to the membrane 17 of the insert in order to reinforce it and is suitable to improve its handling,
- a vapor-permeable protective layer 25, which is associated in a downward region with respect to the membrane 17 of the insert to protect it against impacts, between it and the supporting layer 23,
- a vapor-permeable layer 26 with high resistance to perforation and cutting, for example made of Kevlar®, between the membrane 17 of the insert and the supporting layer 23.

Figure 2A:
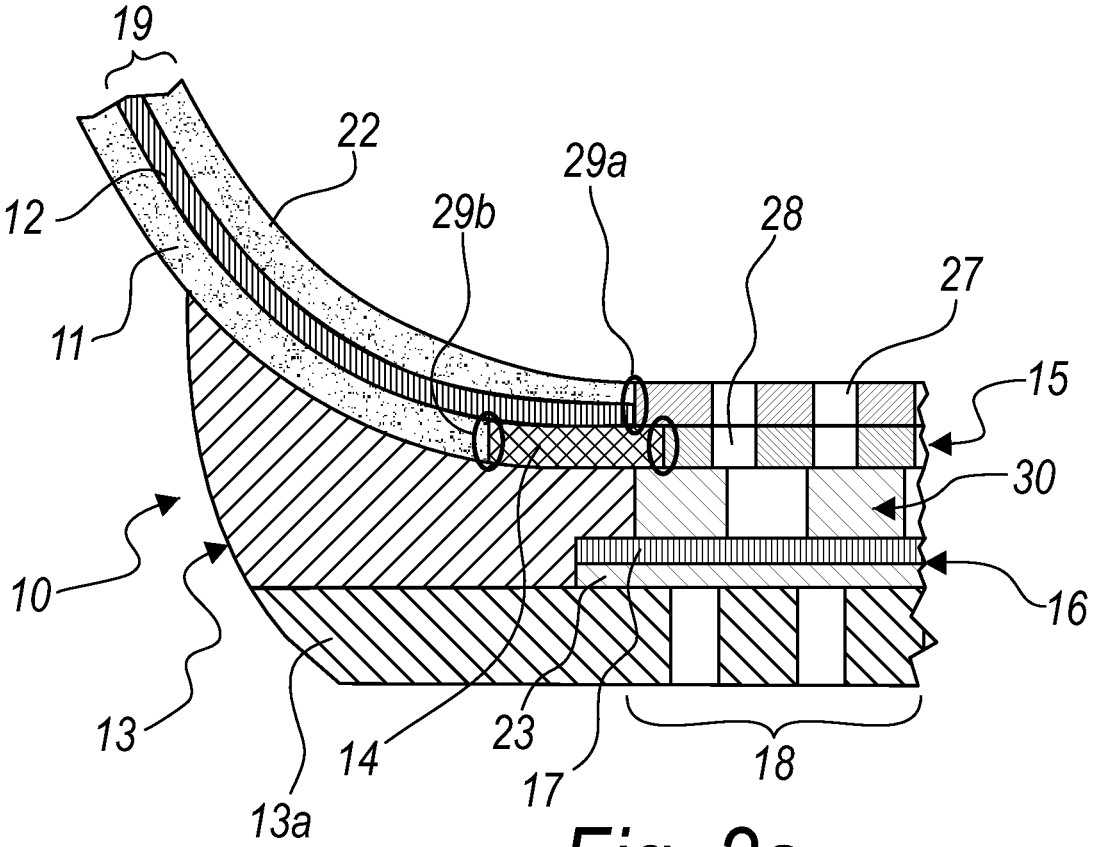
FIGS. 2*a*, 2*b* and 2*c* are enlarged-scale sectional views of a detail of the shoe according to the invention in three variations of a first embodiment.

In a first embodiment, illustrated in a first constructive variation thereof by way of non-limiting example in FIG. 2*a*, the shoe 10 advantageously comprises an inner insole 27, which is vapor-permeable or diffusely perforated and is associated perimetrically with the lower edges of the inner lining 19, conveniently by means of a first Strobel seam 29*a*.

The inner lining 19 conveniently comprises the upper membrane 12, which faces the upper 11, conveniently with the interposition of the fine nylon mesh 20, as shown by way of non-limiting example in FIG. 8.

Advantageously, the inner lining 19 has seams which are sealed by means of sealing adhesives or sealing tapes that are heat-sealed thereon.

The assembly insole 15 preferably comprises a central element 28, which is permeable to water vapor or diffusely perforated, at the inner insole 27.

At the same time, the sealing element 14 is constituted by a frame of the central element 28, which is connected peripherally to the upper 11, conveniently with a second Strobel seam 29*b*, and is arranged so as to straddle the region of connection between the inner lining 19 and the inner insole 27.

The sole 13 provides for the vapor-permeable waterproof insert 16 and the corresponding vapor-permeable portion 18, which are conveniently arranged at the central element 28.

Moreover, the sole 13 is preferably made of polymeric material and is molded by direct injection onto the lower part of the upper 11, at the assembly insole 15, where the sealing element 14 is impregnated by said polymeric material that has permeated through it so as to grip the upper membrane 12, sealing the sole 13 to said upper membrane 12.

Direct injection on the upper is a method of manufacture according to which the sole 13 is provided directly on the upper 11 in a single operation of injecting polymeric material; an appropriately manufactured mold is closed by a metallic last on which the entire upper assembly is fitted.

The polymeric material, which is of course fluid or rendered fluid by heating, is injected into the mold in order to form the sole 13 directly on the bottom of the upper assembly; the almost liquid polymeric material is in fact capable of permeating easily the material of the upper 11 and of the insole 15 and of anchoring itself firmly thereto.

The vapor-permeable waterproof insert 16 is sealed perimetrically to the sole 13 so as to cover the vapor-permeable portion 18, for tightness of the sole 13 to water in the liquid state together with its permeability to water vapor, at the vapor-permeable waterproof insert 16.

In a manner which is an alternative to direct injection and substantially equivalent thereto, the sole 13 is made of polymeric material and is advantageously pre-molded and associated by means of adhesive on the lower part of the upper 11, at the assembly insole 15.

The sealing element 14 is impregnated by said glue that has permeated through it so as to grip the upper membrane 12, sealing the sole 13 to the upper membrane 12.

As an alternative to said glue, it is possible to use adhesive and sealing materials, such as silicone adhesives or thermoplastic adhesives or sealants commonly known as "reactive hot melt", for example polyurethanes such as the one known by the trademark Ipatherm S 14/176, or the like.

In particular, the sealing element 14 is impregnated by said sealing adhesive material, which permeates it so as to grip the upper membrane 12.

The sole 13 is sealed by means of adhesive to the sealing element 14 impregnated by the sealing adhesive material to complete the sealing to the upper membrane 12.

At the same time, the vapor-permeable waterproof insert 16 is connected perimetrically and hermetically to the sole 13 so as to cover the vapor-permeable portion 18, for the tightness of the sole 13 to water in the liquid state together with its permeability to water vapor at the vapor-permeable waterproof insert 16.

In this first variation of said first embodiment, the vapor-permeable waterproof insert 16 is accommodated inside the sole 13, which has a vapor-permeable or perforated portion 30 that covers it and lies opposite the vapor-permeable portion 18 with respect to it.

Figure 2B:
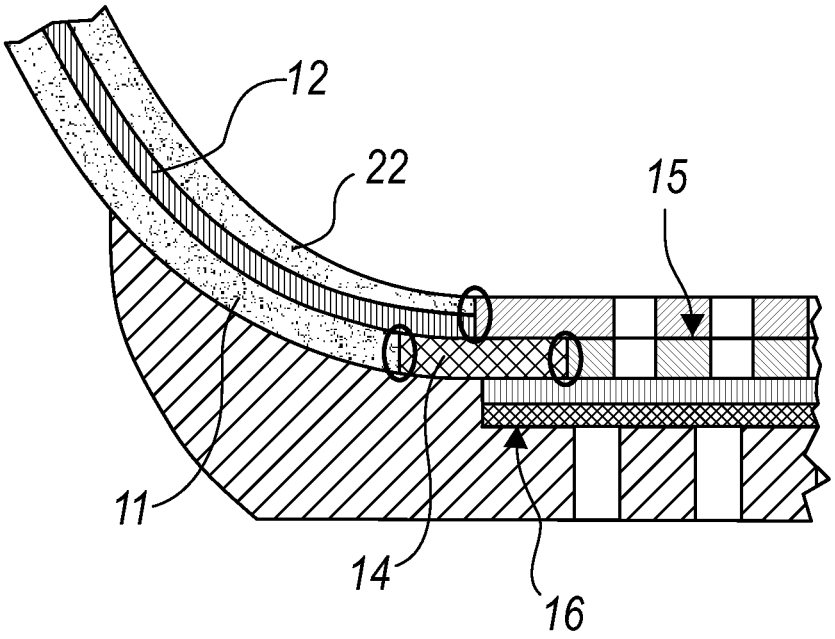

In a second variation of said first embodiment, illustrated by way of example in FIG. 2*b*, the vapor-permeable waterproof insert 16 is superimposed on the sole 13, which supports it, at the assembly insole 15.

In this second variation, the vapor-permeable waterproof insert 16 is sealed perimetrically to the sealing element 14 by the sealing adhesive material that impregnates it or, as an alternative, by means of adhesive or by the polymeric material that constitutes the sole 13.

The sole 13 has a tread layer 13*a*, which is conveniently perforated at the vapor-permeable portion 18.

Figure 2C:
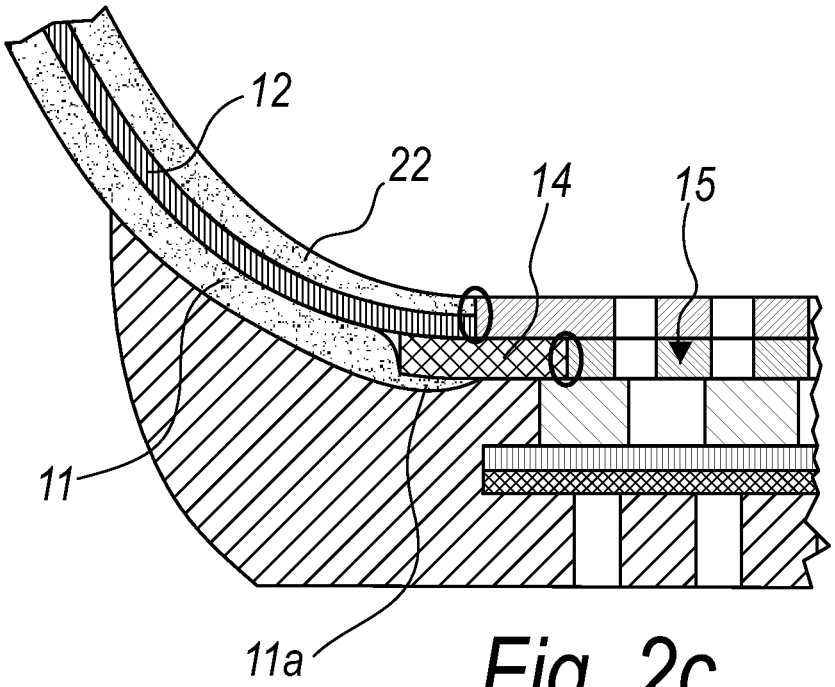
Figure 3:
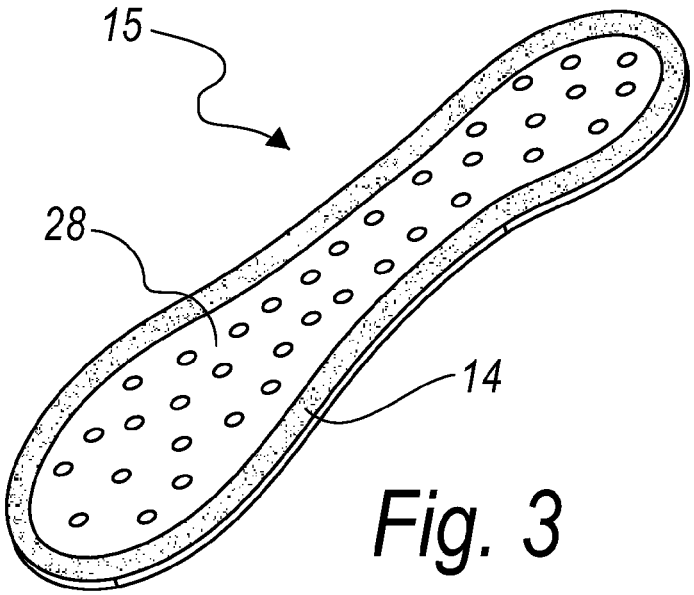
FIG. 3 is a view of a detail of the shoe according to the invention in said first embodiment.

In an alternative assembly solution, illustrated by way of non-limiting example in FIG. 2*c*, the upper 11 has flaps 11*a* for connection to the assembly insole 15 which are folded below it, so as to interpose themselves partially between it and the sole 13, according to the working method known as "AGO lasting".

In particular, said connecting flaps 11*a* are folded below the assembly insole 15 so as to be interposed only partially between the sole 13 and the sealing element 14, so as to not hinder an easy impregnation thereof to seal the upper membrane 12.

It should be noted that the sealing element 14 is not completely covered by the connecting flaps 11*a*, because otherwise the penetration of the polymeric material of the sole 13 or of the sealing material in the sealing element 14 would be prevented.

In this case, during the realization of the upper part of the shoe 10, which has a "AGO lasting" working method, for its connection to the sole 13, the flaps 11*a* of the upper 11 that are folded below the assembly insole 15 are roughed for the anchoring of the adhesive.

During this operation, the assembly insole 15 is interposed between the upper membrane 12, which is connected thereto, and the roughing machine, to contrast damage of the upper membrane 12 by said machine.

Figure 4:
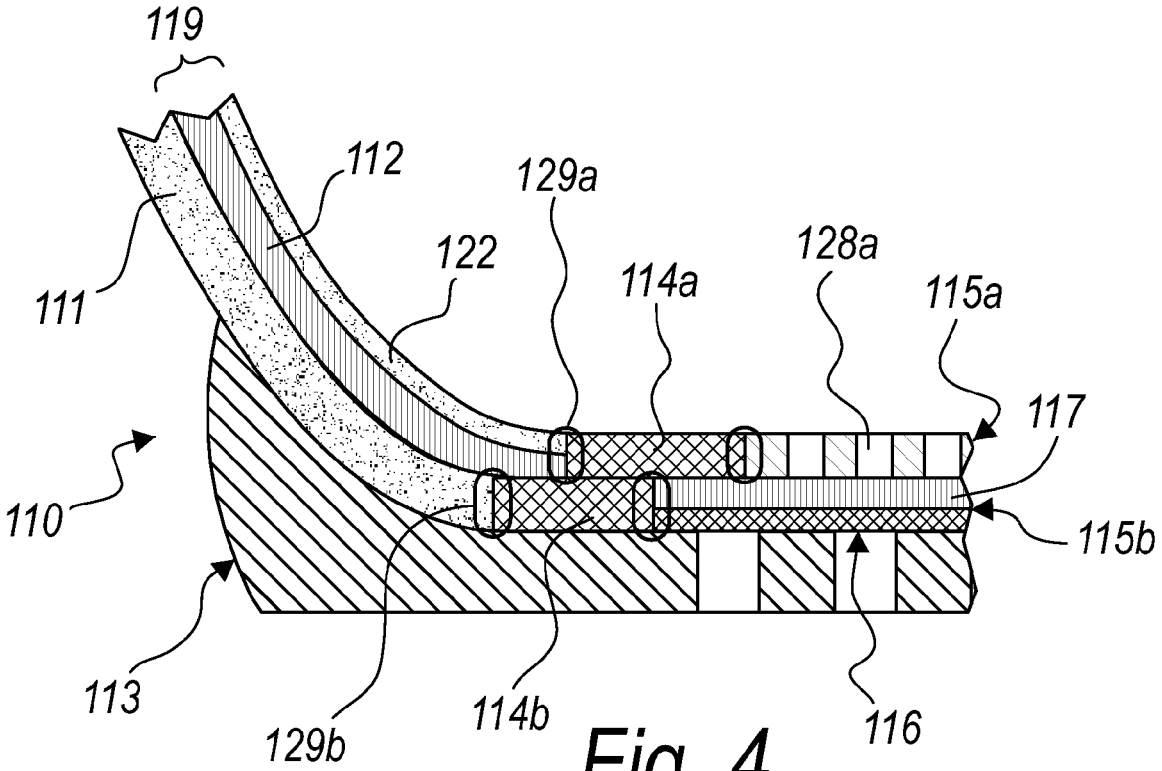
FIG. 4 is an enlarged-scale sectional view of a detail of the shoe according to the invention in a second embodiment.

In a second embodiment, illustrated by way of non-limiting example in FIG. 4, the shoe 110 conveniently comprises two assembly insoles, a first one 115*a* thereof comprising a first central element 128*a*, which is permeable to water vapor or diffusely perforated and is surrounded by a first frame, which forms a first sealing element 114*a*, the second assembly insole 115*b* comprising a second central element which is constituted by the vapor-permeable waterproof insert 116, in a downward region at the first central element 128*a* and surrounded by a second frame that constitutes a second sealing element 114*b*.

Advantageously, the first sealing element 114*a*, forming a frame, is connected perimetrically to the internal lining 119, preferably by means of a first Strobel seam 129*a*, and the second sealing element 114*b*, forming a frame, is arranged so as to straddle the corresponding connecting region and in turn is connected perimetrically to the upper 111, conveniently by means of a second Strobel seam 129*b*.

The inner lining 119 conveniently comprises the upper membrane 112, which faces the upper 111, advantageously with the interposition of a fine nylon mesh, which is associated with the upper membrane 112 in order to improve its handling.

Advantageously, the inner lining 119 has seams which are sealed by means of sealing adhesives or sealing tapes that are heat-sealed thereon.

Moreover, the first sealing element 114*a* is preferably superimposed on, so as to straddle it, the connecting region between the second sealing element 114*b* and the second central element, i.e., the vapor-permeable waterproof insert 116.

The sole 113 is preferably made of polymeric material and is molded by direct injection on the lower part of the upper 111, at the assembly insoles 115*a* and 115*b*, the first sealing element 114*a* and the second sealing element 114*b* being impregnated by said polymeric material that has permeated through them until it grips the upper membrane 112, sealing the upper membrane 112 and the membrane 117 of the insert to the sole 113.

During overmolding of the sole 113 on the lower part of the upper a last for direct injection is provided, onto which the upper part of the shoe is fitted, said last being suitable to prevent the polymeric material that permeates by injection the first sealing element 114*a* from seeping into the shoe through it.

Alternatively, and in a substantially equivalent manner, the sole 113 is conveniently pre-molded by using polymeric material and is associated by means of adhesive on the lower part of the upper 111, at the assembly insoles 115*a* and 115*b*, the first border 114*a* and the second border 114*b* being impregnated by said adhesive that has permeated through them so as to grip the upper membrane 112, to seal the upper membrane 112 and the membrane 117 of the insert to the sole 113.

As an alternative to said adhesive it is possible to use adhesive materials and sealants, such as silicone or thermoplastic adhesives or sealants commonly known as "reactive hot melt", for example polyurethanes such as the one known by the trade name Ipatherm S 14/176, or the like.

In particular, the first sealing element 114*a* and the second sealing element 114*b* are impregnated by sealing adhesive material that has permeated through them so as to grip the upper membrane 112 and the membrane 117 of the insert.

The sole 113 is sealed by means of adhesive to the second sealing element 114*b* impregnated by the sealing adhesive material to complete the seal.

Figure 5:
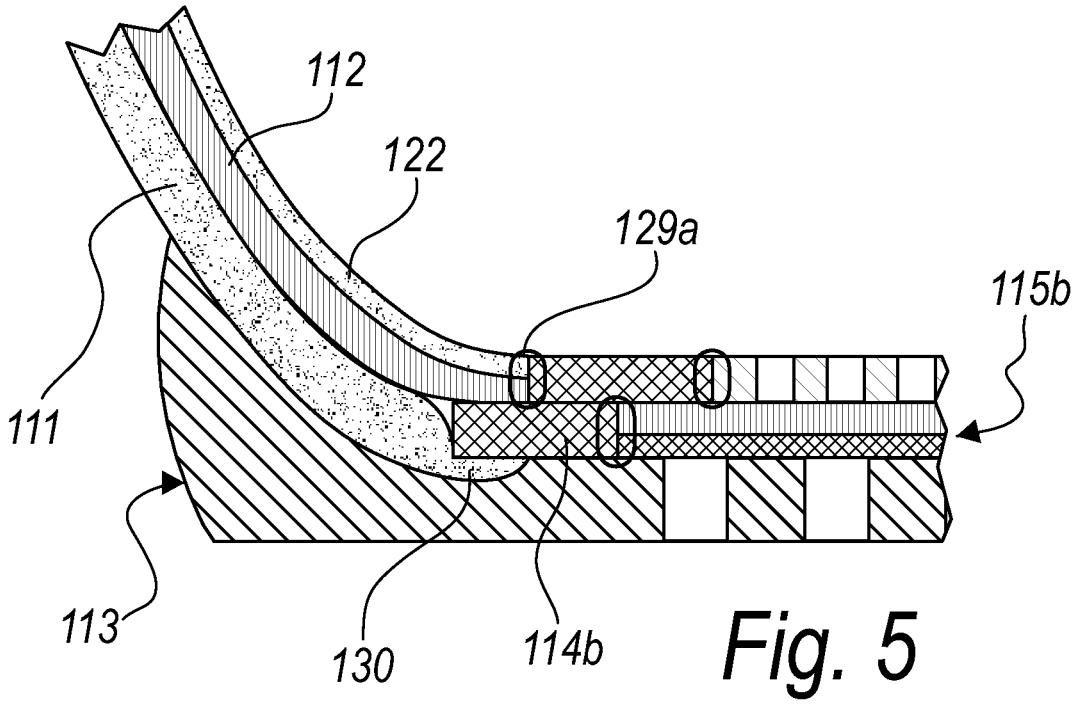
FIG. 5 is an enlarged-scale sectional view of a detail of the shoe according to the invention in a variation with respect to said second embodiment.

In this second embodiment also, in an alternative assembly solution, illustrated by way of non-limiting example in FIG. 5, the upper 111 has flaps 130 for connection to the assembly insole 115*b* which are folded below it, so as to be interposed partially between it and the sole 113, according to the working method known as "AGO lasting".

In particular, the connecting flaps 130 are folded below the assembly insole 115*b* so as to be interposed only partially between the sole 113 and the second sealing element 114*b*, so as to not hinder an easy impregnation to seal the upper membrane 112.

Figure 6:
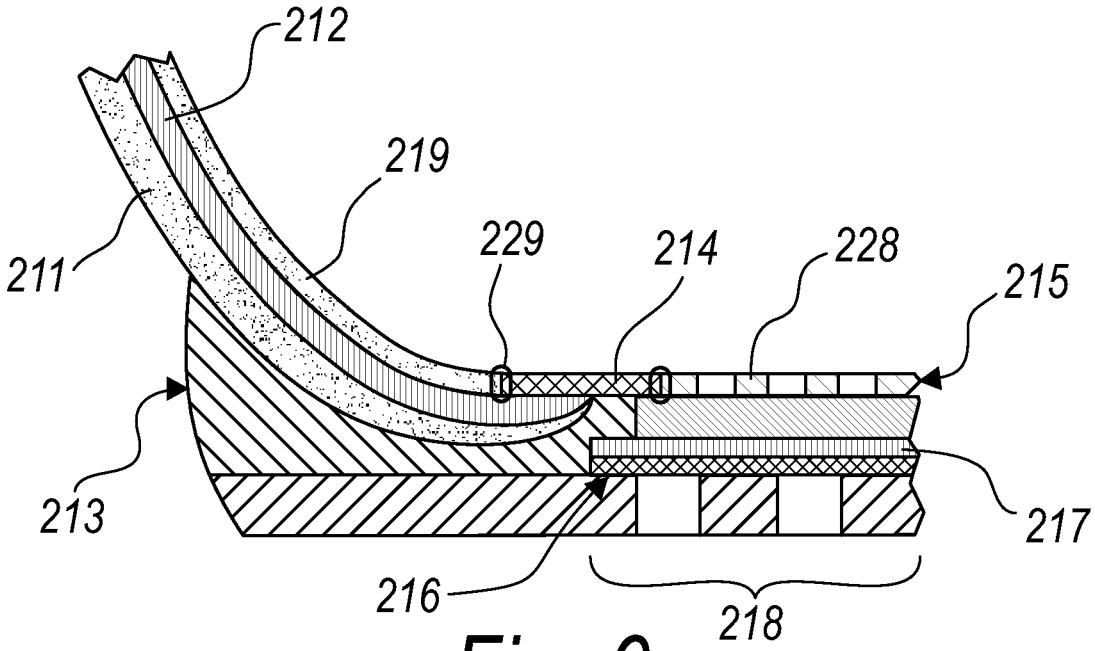
FIG. 6 is an enlarged-scale sectional view of a detail of the shoe according to the invention in a third embodiment.

In a third embodiment, illustrated by way of non-limiting example in FIG. 6, the assembly insole 215 comprises a central element 228, which is permeable to water vapor or diffusely perforated; at the same time, the sealing element 214 conveniently is constituted by a frame with respect to the central element 228.

Preferably, the upper membrane 212 is internally associated with the upper 211 at least in a part thereof and is conveniently covered, for example on its face, directed toward the inside of the shoe, by at least a fine nylon mesh that is suitable to improve its handling.

Advantageously, the upper 211 has seams that are sealed by means of sealing adhesives or sealing tapes that are heat-sealed thereon.

The upper 211 and the upper membrane 212 are connected in a downward region with respect to the sealing element 214, so as to be interposed partially between said sealing element and the sole 213 according to so-called "AGO lasting" working method, with the lower flaps of the upper membrane 212 interleaved between the upper 211 and the sealing element 214, at their connection.

In particular, said lower flaps of the upper membrane 212 are folded below the assembly insole 215 so as to be interposed only partially between the sole 213 and the sealing element 214, so as to not hinder an easy impregnation to seal the upper membrane 212.

The lining 219 is conveniently connected to the perimetric peripheral region of the sealing element 214, preferably by means of a Strobel seam 229.

Advantageously, the sole 213 has the vapor-permeable waterproof insert 216 and the corresponding vapor-permeable portion 218 at the central element 228.

Figure 7:
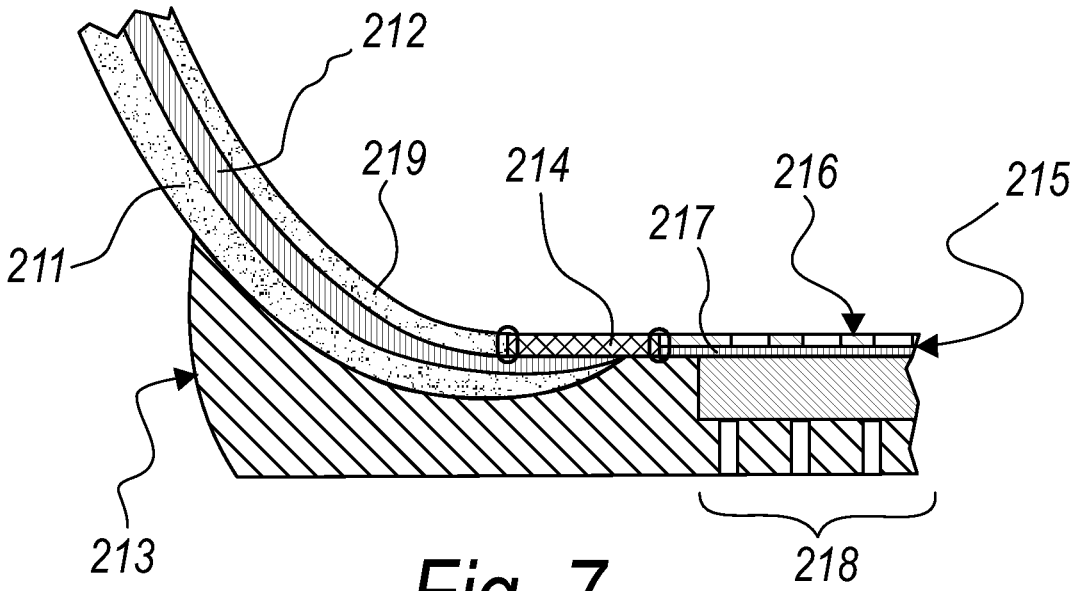
FIG. 7 is an enlarged-scale sectional view of a detail of the shoe according to the invention in a variation with respect to said third embodiment.

In a variation to said embodiment, illustrated by way of non-limiting example in FIG. 7, the central element 228 is constituted by the vapor-permeable waterproof insert 216.

In this variation, the vapor-permeable waterproof insert 216 advantageously has the membrane 217 of the insert connected hermetically at a perimetric band, to the sole 213.

The membrane 217 of the insert conveniently faces the vapor-permeable portion 218 of the sole 213 and is covered by a protective element made of vapor-permeable material, which leaves said perimetric band thereof exposed.

Moreover, the membrane 217 of the insert is connected perimetrically to the sealing element 214.

The sole 213 is preferably made of polymeric material and is molded by direct injection onto the lower part of the upper 211, at the assembly insole 215, where the sealing element 214 is impregnated by said polymeric material that has permeated through it so as to grip the upper membrane 212, sealing it to the sole 213.

Said polymeric material further grips the membrane 217 of the insert.

In a manner which is alternative to direct injection and substantially equivalent, the sole 213 is made of polymeric material and advantageously pre-molded and associated by means of adhesive on the lower part of the upper 211, at the assembly insole 215.

The sealing element 214 is impregnated by said adhesive that has permeated through it so as to grip the upper membrane 212, sealing it to the sole 213.

Conveniently, the membrane 217 of the insert is bonded by adhesive to the sole 213 at a perimetric band thereof.

As an alternative to said adhesive, it is possible to use adhesive and sealing materials, such as silicone or thermoplastic adhesives or sealants commonly known as "reactive hot melt", for example polyurethanes such as the one known by the trade name Ipatherm S 14/176, or the like.

In practice it has been found that the invention achieves the intended aim and objects, providing a waterproof and vapor-permeable shoe that has an effective seal of the connecting regions between the insole, the membrane and the sole, provided by the sealing element formed by the assembly insole.

In particular, the shoe according to the invention allows an effective sealed connection of the membrane of the upper to the sole and/or to a membrane of the insert.

Moreover, a shoe which is impermeable to water and permeable to water vapor according to the invention is structurally simple to obtain, tough and durable, and can be manufactured with known systems and technologies.

The invention thus conceived is susceptible of numerous modifications and variations, all of which are within the scope of the appended claims; all the details may further be replaced with other technically equivalent elements.

In practice, the materials used, as long as they are compatible with the specific use, as well as the contingent shapes and dimensions, may be any according to requirements and to the state of the art.

The disclosures in Italian Patent Application No. PD2008A000377 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A waterproof and vapor-permeable shoe, comprising:

an upper that is lined at least partially by an upper membrane which is impermeable to water in a liquid state and permeable to water vapor, the upper membrane being connected hermetically to a sole which is impermeable to water in the liquid state;

an inner lining, which comprises at least one among: a vapor-permeable padding made of open-cell foamed polymer, and a vapor-permeable layer which is internal to the shoe; and a vapor-permeable or diffusely perforated inner insole, which is associated perimetrically with lower edges of said inner lining which comprises said upper membrane, wherein said hermetic connection is provided by a sealing element comprised in an assembly insole, said assembly insole comprising a central element, which is permeable to water vapour or diffusely perforated, at said inner insole, the sealing element being permeable with respect to sealing material, or a glue, a sealing adhesive, or a polymeric material for providing the sole, said sealing element impregnated with said sealing material gripping said upper membrane and being connected to the sole or forming a single body therewith, sealing said sole to said upper membrane, and wherein said sealing element being constituted as a border with respect to said central element, which is connected peripherally to said upper and is arranged so as to straddle a region for connecting said inner lining to said inner insole.

2. The shoe according to claim 1, further comprising:

a vapor-permeable waterproof insert, which comprises a membrane of the insert that is impermeable to water in the liquid state and permeable to water vapor, said insert being arranged at at least one vapor-permeable portion of said sole defined by at least one opening or by a plurality of holes, and said upper membrane being connected hermetically at least through said sealing element, for tightness to water in the liquid state of said shoe, said sealing element being provided at the peripheral region of said vapor-permeable portion and of said membrane of the insert that covers it.

3. The shoe according to claim 2, wherein said upper membrane and said membrane of the insert are made of a material selected among expanded polytetrafluoroethylene, polyurethane.

4. The shoe according to claim 2, wherein said vapor-permeable waterproof insert comprises at least one among a vapor-permeable supporting layer, which is arranged below said membrane of the insert, a vapor-permeable fine mesh, made of synthetic material associated in an upper region with respect to said membrane of the insert to reinforce it, a vapor-permeable protective layer, which is associated in a lower region with said membrane of the insert to protect it against impacts, between it and said supporting layer, a vapor-permeable layer with high resistance to perforation and cutting, which is between said membrane of the insert and said supporting layer.

5. The shoe according to claim 2, wherein said sole has said vapor-permeable waterproof insert and the corresponding said vapor-permeable portion at least at said central element.

6. The shoe according to claim 2, wherein said sole is made of polymeric material and is molded by direct injection on a lower part of said upper, at said assembly insole, said sealing element being impregnated by said polymeric material that has permeated through it so as to grip said upper membrane, sealing said sole to said upper membrane, said vapor-permeable waterproof insert being sealed perimetrically to said sole so as to cover said vapor-permeable portion, for tightness of said sole to water in the liquid state together with its permeability to water vapor at said vapor-permeable waterproof insert.

7. The shoe according to claim 2, wherein said sole is made of polymeric material and is pre-molded and associated by adhesive on a lower part of said upper, at said assembly insole, said sealing element being impregnated by said adhesive, which has permeated through it so as to grip said upper membrane, sealing said sole to said upper membrane, said vapor-permeable waterproof insert being connected perimetrically to said sole so as to form a seal so that it covers said vapor-permeable portion, for tightness of said sole to water in the liquid state together with its permeability to water vapor at said vapor-permeable waterproof insert.

8. The shoe according to claim 2, wherein said sole is made of polymeric material, is pre-molded and is associated by adhesive on a lower part of said upper, at said assembly insole, said sealing element being impregnated by sealing adhesive material that has permeated through it so as to grip said upper membrane, said sole being sealed by adhesive to said sealing element impregnated by said sealing adhesive material to complete the seal to said upper membrane, said vapor-permeable waterproof insert being connected perimetrically so as to form a seal to said sole so as to cover said vapor-permeable portion, for tightness of said sole to water in the liquid state together with its permeability to water vapor at said vapor-permeable waterproof insert.

9. The shoe according to claim 1, wherein said sealing element is made of a material selected among three-dimensional fabric, synthetic material mesh, metallic material mesh, aramid fiber fabric.

10. The shoe according to claim 1, further comprising a fine nylon mesh, which is intimately connected to said upper membrane to improve its handling.

11. The shoe according to claim 1, wherein said upper comprises flaps for connection to said assembly insole which are folded below it, so as to interpose themselves partially between said sealing element and said sole, according to a AGO lasting working method.

* * * * *